United States Patent [19]

Weiner et al.

[11] Patent Number: 4,633,974

[45] Date of Patent: Jan. 6, 1987

[54] INFLATABLE ROOF SAFETY RIGGING SYSTEM

[76] Inventors: Robert I. Weiner, 305 W. Chesapeake Ave., Towson, Md. 21502; Robert Magladry, 1125B Charles View Way, Towson, Md. 21204

[21] Appl. No.: 796,726

[22] Filed: Nov. 12, 1985

[51] Int. Cl.[4] ..... A62B 37/00

[52] U.S. Cl. ..... 182/3; 182/12; 182/43; 52/2

[58] Field of Search ..... 182/3, 4, 5, 6, 7, 10, 182/11, 12, 36, 82, 45, 42; 52/2

[56] References Cited

U.S. PATENT DOCUMENTS

| | | | |
|---|---|---|---|
| 194,625 | 8/1877 | Staples | 182/42 |
| 581,197 | 4/1897 | Cook | 182/12 |
| 3,237,717 | 3/1966 | Jackson | 182/3 |
| 3,772,836 | 11/1973 | Geiger | 52/80 |
| 3,835,599 | 9/1974 | Geiger | 52/80 |
| 4,249,713 | 2/1981 | Glynn | 182/3 |

FOREIGN PATENT DOCUMENTS

| | | | |
|---|---|---|---|
| 3023489 | 1/1982 | Fed. Rep. of Germany | 182/3 |
| 3215328 | 10/1983 | Fed. Rep. of Germany | 182/3 |
| 59479 | 11/1969 | German Democratic Rep. | 182/3 |

*Primary Examiner*—Reinaldo P. Machado
*Attorney, Agent, or Firm*—Peter L. Klempay

[57] ABSTRACT

A rigging system for retrieving a worker in the event of the collapse or tearing of a peripheral panel of an air-supported fabric roof employs one or more endless cables each entrained over pulleys located at the edge of the roof and inwardly therefrom. The worker is connected to one run of the cable by a safety line and harness. In the event of an accident, the cables are driven, for example by a detachable motor rotating one of the pulleys, to move the worker to the vicinity of the peripheral wall.

9 Claims, 7 Drawing Figures

INFLATABLE ROOF SAFETY RIGGING SYSTEM

The present invention pertains to safety rigging systems for use by workers on the roofs of inflatable, air-supported structures and, more particularly, to such systems with provision for safely retrieving a worker in the event of failure of a section of the roof.

BACKGROUND OF THE INVENTION

Roofs of air-supported fabric panel construction, for example of the type disclosed in U.S. Pat. Nos. 3,772,836, Geiger, and 3,835,599, Geiger, have been constructed on large structures such as athletic stadiums and field houses as these roofs provide an unobstructed interior of large size. As is discussed in pending U.S. patent application Ser. No. 624,759, filed June 26, 1984, entitled SAFETY RIGGING SYSTEM FOR INFLATABLE ROOF STRUCTURES (the disclosure of which is hereby incorporated by reference), snow accumulation on such roofs can lead to excessive loading of the structure and the partial or total collapse thereof. The above identified application discloses a rigging system which permits workers to move safely across the roof surface to conduct snow removal operations, for example.

It will be appreciated that, on a domed roof structure, the outboard regions of the roof, those adjacent the vertical walls of the structure, are normally subjected to the greatest accumulation of snow as the aerodynamic configuration of the roof results in increased snow deposition in these regions and the fact that the snow removal processes on the remaining portions of the roof moves the snow toward the periphery. In addition, due to the curvature of the roof, these regions have the greatest slope. Consequently, the outboard regions of the roof represent the most hazardous zones for workers on the roof. Moreover, a snow removal crew always must traverse the outboard regions in order to reach other portions of the roof.

In light of the increased hazards encountered at the periphery of the roof, additional safety provisions in these regions are desireable. The ability to rapidly recover a worker who has fallen through an opening in the roof without requiring others to be on the roof is obviously an advantage, particularly as the occurance of an opening in a roof panel results in a dangerous working condition on both the damaged panel and the adjacent panels.

It is the primary object of the present invention to provide a rigging system for use on inflated roof structures which facilitates the recovery of the worker in the event of the collapsing or tearing of the roof panel.

It is a further object of the present invention to provide a safety rigging system for use on an inflated roof structure which permits the recovery of a worker following the failure of a roof panel without requiring others to climb upon or move on the roof structure.

It is also an object of the present invention to provide such a rigging system which may be incorporated into the structure of an air-supported fabric panel roof structure at the time of construction or installed on an existing roof of that type with a minimum of modification thereof.

Another object of the present invention is the provision a safety rigging system for use on air-supported fabric panel roof structures which allows the worker a substantial freedom of movement under normal working conditions.

SUMMARY OF THE INVENTION

The above and other objects of the invention which will become apparent hereinafter are achieved by the provision of a safety rigging system for use by workers moving on the exterior of an air-supported, fabric panel roof which system includes at least one and, preferrably, a pair of endless cables; in conjunction with each cable, a first pulley and a second pulley, the pulleys being mounted, respectively, adjacent the edge of the roof and on the roof surface with the cable being entrained on the pulleys to form parallel, substantially taut cable runs; adjacent cables of each pair being substantially parallel to one another; drive means for rotating at least one of the pulleys; a safety harness wearable by the worker; and safety lines for connecting the harness to one run of the cable or to one run of each of a pair of cables.

As is the case with the safety rigging system disclosed in the above identified application, the connections of the safety lines to the safety cables are, preferrably, releaseable rope grabs, thus permitting the worker to shift positions at will under normal working conditions. In the event the roof panel fails and the worker falls through the roof, the rope grabs lock on the corresponding cable run or runs and the worker is suspended by means of the cable or cables, safety lines and harness. By actuation of the drive means, the worker may be pulled toward the peripheral wall of the structure where the rescue can be completed without the need for others to climb or move on the roof surface.

For a more complete understanding of the invention and the objects and advantages thereof, reference should be had to the accompanying drawing and the following detailed description wherein a preferred embodiment of the invention is illustrated and described.

DESCRIPTION OF THE PREFERRED EMBODIMENT

Figures 1, 3:
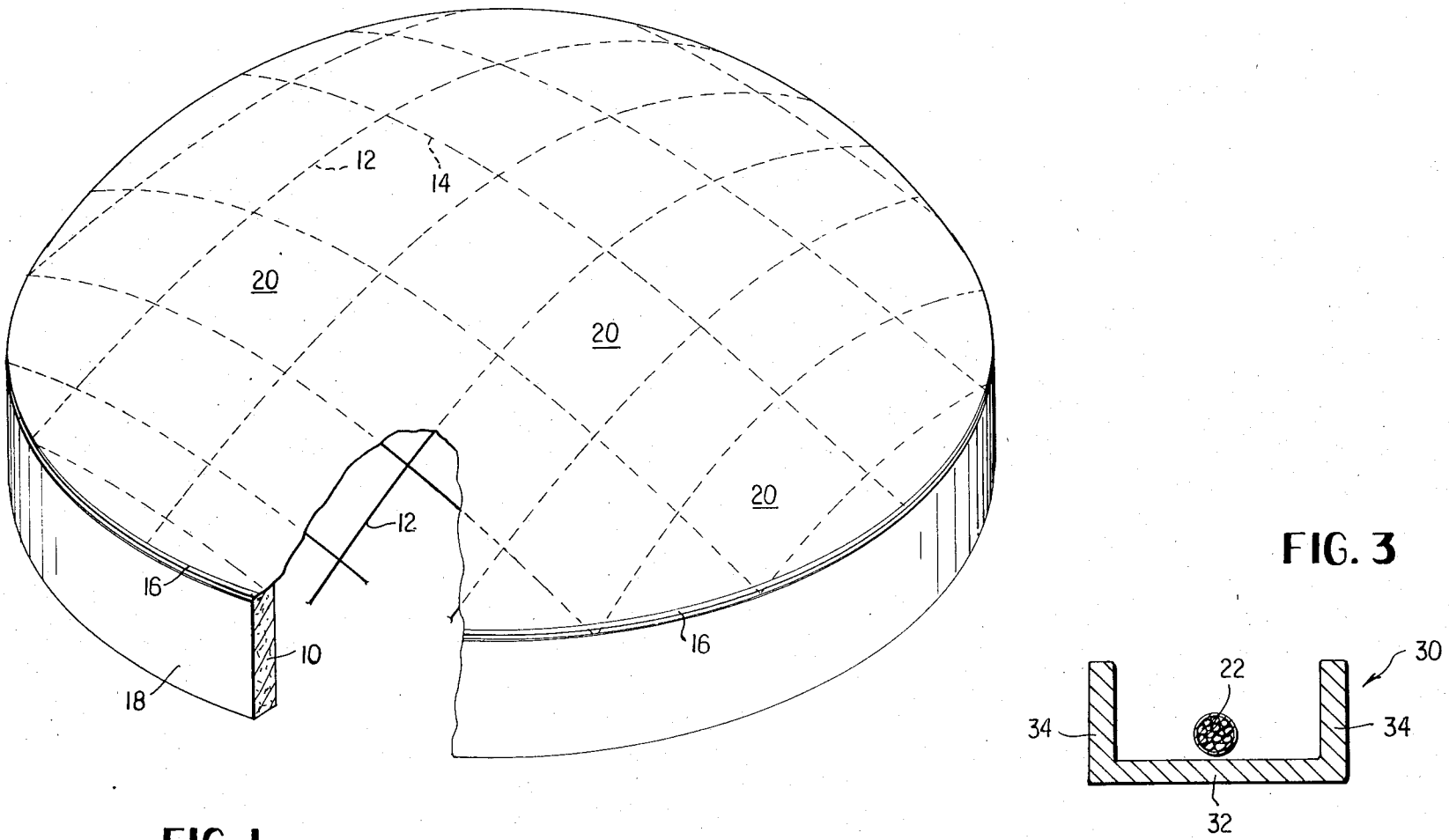
FIG. 1 is a perspective view, partially in section, illustrating the construction of an air-supported fabric roof construction.
FIGS. 3, 4 and 5 are fragmentary cross-sectional views taken on the lines 3—3, 4—4 and 5—5, respectively, of FIG. 2.

A typical air-supported fabric roof construction is illustrated in FIG. 1 and includes a concrete compression ring 10 surrounding the area covered by the roof and serving to anchor first and second sets of cables 12 and 14 extending across the roof and interconnected at their points of intersection. Attached to the cables by suitable lashings, for example, and to the concrete ring with hold down strips or the like 16 are fabric panels, typically of Teflon or vinyl coated fiberglass, forming the roof membrane. The space within the confines of the roof is maintained at a pressure slightly above atmospheric so as to pre-tension the roof and form a domed structure. The compression ring 10 may be the upper portion of the peripheral wall 18 of the structure. It will be understood that the safety rigging system of the present invention is not limited to use with the specific roof construction illustrated.

The safety rigging system of the present invention is intended for use in the outer regions of the roof, that is, in conjunction with the roof panels 20 extending between the compression ring 10 and the first ones of the cables 12 and 14 located inwardly therefrom. As was discussed above, these panels are located in the regions in which the greatest snow accumulation occurs and which must be traversed by the workers in order to reach the central regions of the roof. Preferrably, the remainder of the roof is equipped with the rigging system discloses in the above-mentioned application Ser. No. 624,759.

Figure 2:
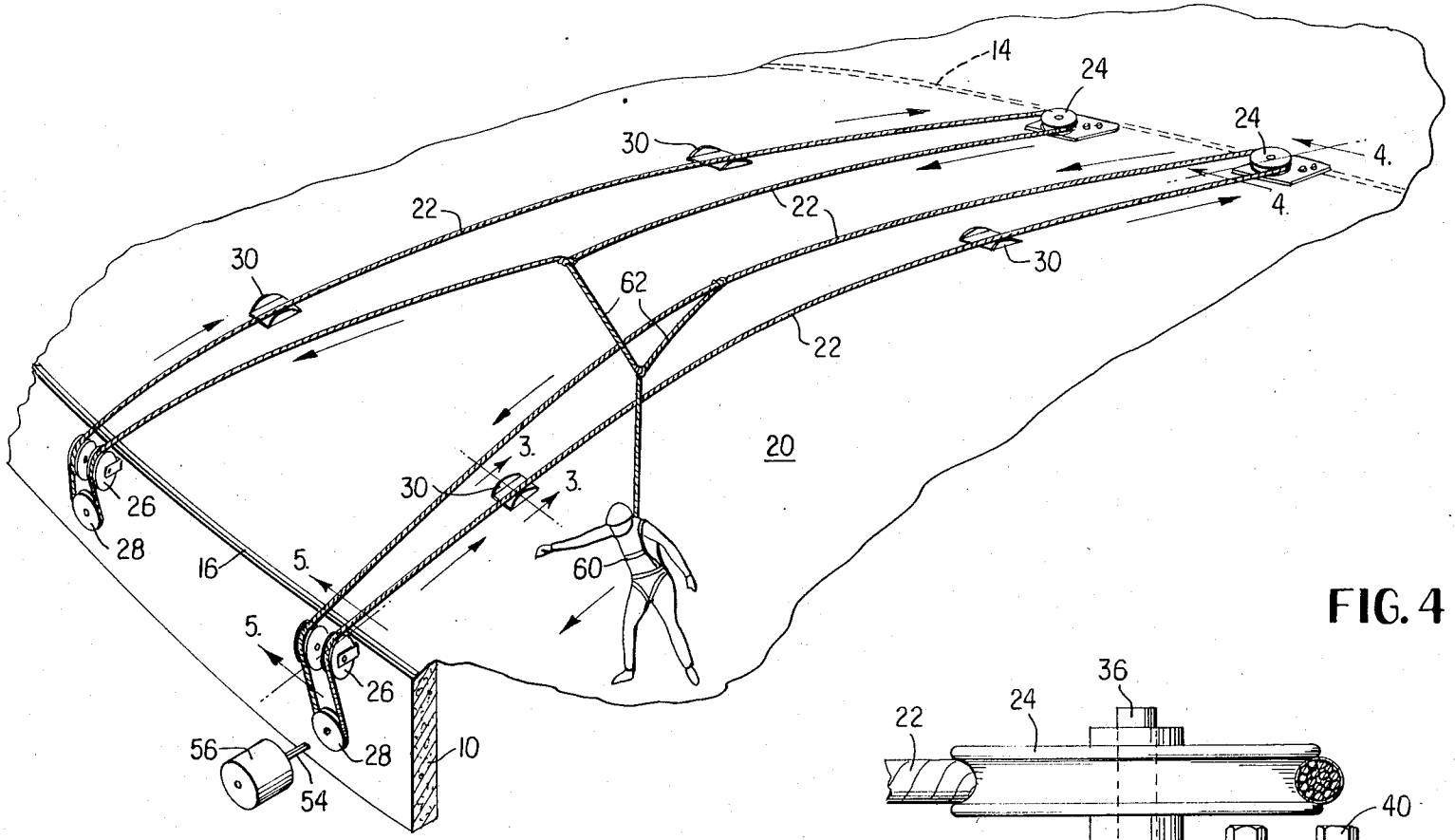
FIG. 2 is a fragmentary perspective view of a portion of the roof structure of FIG. 1 equipped with the safety rigging system of the present invention.

Referring to FIG. 2, the rigging system of the present invention includes a series of endless cables 22 with each cable extending across the panel 20 and entrained over a first pulley 24 mounted on the roof surface in the vicinity of the first roof structure cable 12 or 14, a pair of second pulleys 26 mounted on the peripheral ring or wall 10, and a third pulley 28 mounted on the wall 10 below the second pulleys. The endless cable 22 is of such length as to form substantially taut runs between the first and third pulleys.

Guide ways 30 may be provided on the roof panel 20 at intervals along the cable run to maintain the cable position and the prevent wear of both the cable and the roof fabric. As is shown in FIG. 3, each guide way includes a bottom wall 32 and upwardly extending, spaced side walls 34 to define an upwardly opening guide channel. The side walls of the guide way curve downwardly at their ends to form a smooth transition from the bottom wall.

Figure 4:
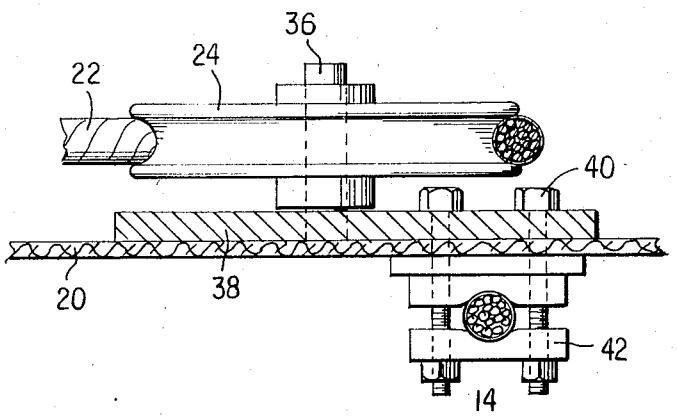
Figure 5:
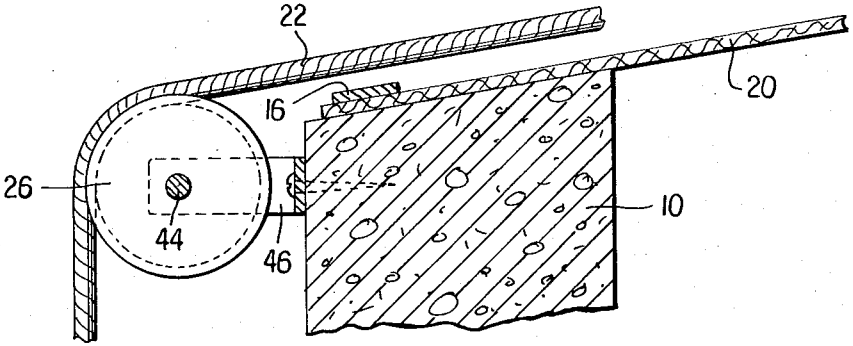

As is shown in FIG. 4, each first pulley 24 may be journalled on a stub shaft 36 extending upwardly from a mounting plate 38 positioned on the outer surface of the roof and connected to the corresponding underlying support cable 12 or 14 by bolts 140 and cable clamps 42. Suitable sealants are employed in conjunction with the mounting plate and bolts to maintain the weather-tight integrity of the roof membrane.

Each pair of second pulleys 26 may be journalled on opposite ends of a common shaft 44 carried by a bracket 46 which is secured to the peripheral wall or ring 10. These pulley pairs serve to turn the runs of the endless cables 22 between their principal runs generally parallel to the roof surface and end runs extending downwardly to the third pulley 28.

Figure 7:
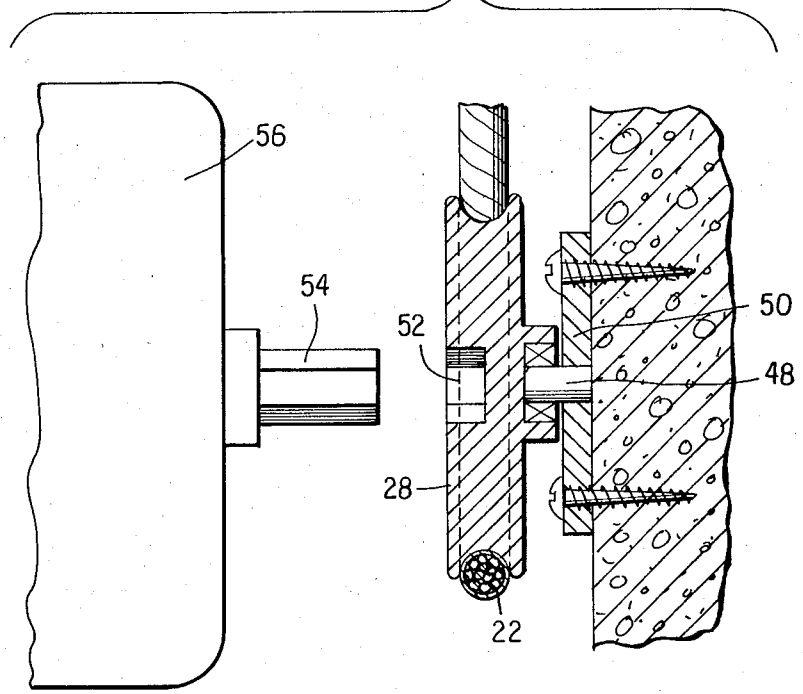
FIG. 7 is a transverse cross-sectional view taken on the line 7—7 of FIG. 6.
Figure 6:
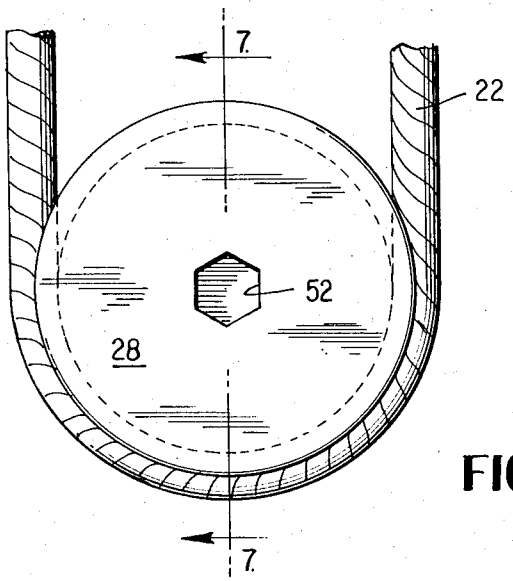
FIG. 6 is an elevational view of the drive pulley employed in the rigging system.

As will be seen from FIGS. 6 and 7, the third pulley 28 is journalled on a stub shaft 48 carried by a plate 50 adapted to be attached to the wall 10. The pulley has a socket 52 of, for example, hexagonal configuration extending inwardly from the exposed face thereof on its axis for removeable driving engagement with the output shaft 54 of a portable electric motor 56 or other suitable drive means, the output shaft being of complementary configuration to the socket 52.

As is the case in the use of the safety system described in the above-mentioned application, each worker wears a safety harness 60 when on the roof. When working on or traversing the outermost panels of the roof, the panels which are equipped with the rigging system of the present invention, each worker attaches a safety line 62 to the harness and, by means of a rope grab 64, to one run of at least one of the endless cables 22 in the vicinity of the area being traversed. Preferrably and as is shown in FIG. 2, the safety lines 62 are connected to one run of each of two adjacent safety cables. If failure of the panel occurs, the worker will be suspended by the harness, safety lines and the cable run or runs. Driving of the safety cable or cables, either manually or by means of the portable motor 56, moves the now suspended worker toward the inner face of the ring or wall 10 where the worker may either climb to safety or be assisted down with a ladder.

While a preferred embodiment of the invention has been described and illustrated, it will be understood that changes and additions may be had therein and thereto without departing from the spirit of the invention. Reference should, accordingly, be had to the appended claims in determining the true scope of the invention.

We claim:

1. A safety rigging system for use by workers moving on the exterior of an air-supported fabric roof structure which spans across peripheral walls comprising:

at least one endless cable;

for each said cable, a first pulley mounted on the roof structure at a point spaced from the peripheral wall, a pair of second pulleys mounted on the peripheral wall at the juncture thereof with said roof structure, and a third pulley mounted on the peripheral wall below said pair of second pulleys, said cable being entrained over said pulleys so as to define parallel cable runs extending across the roof surface between said first pulley and said pair of second pulleys and runs extending between said pair of second pulleys and said third pulley;

means for rotating said third pulley;

at least one safety line;

means for connecting said safety line to one of said cable runs on said roof surface; and means for connecting the safety line to the worker.

2. The safety rigging system of claim 1 wherein said means for rotating includes an electric motor detachably connectable to said third pulley.

3. The safety rigging system of claim 1 wherein at least two endless cables are provided, said cables extending in spaced, generally parallel relation to one another.

4. The safety rigging system of claim 1 further including at least one cable guide way mounted on said roof surface between said first pulley and one of said pair of second pulleys, said cable guide way having a base portion and parallel side walls extending upwardly from said base portion and defining an open-topped channel for reception of said one of said cable runs.

5. A safety rigging system for use by workers moving on the exterior of an air-supported fabric roof structure which spans across peripheral walls comprising:

at least one endless cable;

for each said cable, at least two pulleys mounted on said roof structure and said wall, respectively, and entraining said cable to define parallel cable runs extending inwardly across said roof surface from said peripheral wall;

means for driving said cable;

at least one safety line;

means for connecting said safety line to one of said cable runs; and means for connecting said safety line to the worker.

6. The safety rigging system of claim 5 wherein a plurality of endless cables are provided, adjacent ones of said cables being spaced from and generally parallel to one another.

7. The safety rigging system of claim 6 wherein said means for connecting includes means for connecting said safety line to one run of each of two adjacent cables.

8. The safety rigging system of claim 5 wherein said means for driving said cable includes a motor detachably connectable to one of said pulleys for rotating the same.

9. The safety rigging system of claim 5 further including at least one cable guide way mounted on said roof surface in alignment with one of said cable runs, said guide way having a base portion and parallel side walls extending upwardly from said base portion and defining an open-topped channel for reception of said one of said cable runs.

* * * * *